United States Patent [19]

Lingenfelder

[11] 4,250,688

[45] Feb. 17, 1981

[54] METHOD AND APPARATUS FOR INSERTING FILLED, BAG-LIKE CONTAINERS INTO BOXES, CARTONS OR THE LIKE

[76] Inventor: Ottmar Lingenfelder, Auf dem Kyberg 27, 8024 Deisenhofen, Fed. Rep. of Germany

[21] Appl. No.: 922,318

[22] Filed: Jul. 6, 1978

[30] Foreign Application Priority Data

Jul. 7, 1977 [DE] Fed. Rep. of Germany ..... 2730799
Jul. 7, 1977 [DE] Fed. Rep. of Germany ..... 2730805

[51] Int. Cl.[3] ..... B65B 63/02; B65B 57/20

[52] U.S. Cl. ..... 53/438; 53/443; 53/496; 53/501; 53/529; 53/542; 53/252; 198/429

[58] Field of Search ..... 53/438, 443, 501, 529, 53/542, 252, 496, 252, 438, 443, 501, 529, 542; 198/429; 414/89

[56] References Cited

U.S. PATENT DOCUMENTS

| | | | |
|---|---|---|---|
| 3,370,549 | 2/1968 | Livingston | 53/252 X |
| 3,608,269 | 9/1971 | Gore | 53/529 |
| 3,655,180 | 4/1972 | Holler | 53/542 X |
| 3,821,874 | 7/1974 | Jones | 53/252 X |

*Primary Examiner*—Travis S. McGehee
*Attorney, Agent, or Firm*—Omri M. Behr

[57] ABSTRACT

A method and apparatus for inserting filled bag-like containers into despatch or display boxes, cartons or the like, comprising the steps of feeding the containers to a conveying system which has a plurality of compartments for receiving the containers, each compartment extending transversely to the conveying direction conveying the containers to an ejector station, ejecting a preselected number of containers at the ejector station from said compartments to a buffer store where initially the containers are loosely arranged, subsequently pressing the containers in the buffer store closely against each other, moving the tightly packed containers into a position directly in front of the opening of a carton to be filled and loading the tightly packed containers into the opened carton. For acceleration of the operating cycle means for the ejector system are provided for reciprocating movement in a direction parallel to the direction of movement of the conveying system such that movement of the ejector system in the conveying direction takes place in synchronism with the conveying speed of the conveying system.

68 Claims, 10 Drawing Figures

METHOD AND APPARATUS FOR INSERTING FILLED, BAG-LIKE CONTAINERS INTO BOXES, CARTONS OR THE LIKE

BACKGROUND OF THE INVENTION

1. Field of the Invention

The invention relates to a method and apparatus for inserting filled bag-like containers, more particularly filled flat bags, into despatch or display boxes, cartons or the like.

2. Discussion of the Relevant Art

It is known to feed containers to a conveying device having open compartments for receiving the containers and for conveying the containers to an ejector station at which a pre-selected number of containers are ejected into an opened carton by means of an ejector device.

Disposable packages are not only being used increasingly in the foodstuffs industry but also in the pharmaceutical and cosmetics industry. Bag-like containers in particular are very popular and are increasingly used as consumer-oriented small packs for sweets, potato powder, potato chips, cream, milk, fruit juice and the like.

Mechanized packaging into despatch cartons or display cartons of these relatively form-stable containers, which are therefore difficult to handle by machines, represents a problem. More particularly, in the method of the kind described hereinbefore it is very difficult for the containers, which are ejected from the compartments of the conveying device and are loosely arranged adjacently to each other by means of their flat sides, to be loaded into the cartons by means of the usually comb-shaped ejector device because owing to their inadequate self-support and intrinsic instability such containers have a tendency to laterally escape from the pressure of the ejecting device. Accordingly, the bag-like containers can readily be bunched in the carton opening and can also be damaged.

Furthermore, the space of the carton which is to be filled is only incompletely utilized because prior to insertion into the carton the bag-like containers are placed one against the other only loosely, i.e. with clearance between their flat sides and/or in irregular distribution of the material in the individual containers.

It is one object of the present invention to provide a method which avoids the previously-mentioned disadvantages and more particularly permits the bag-like containers to be reliably inserted into a bag carton, or the like. Its another object of the invention to provide a method which permits gaining time so as to obtain a more rapid operating cycle.

SUMMARY OF THE INVENTION

According to one aspect of the invention there is provided a method for inserting filled bag-like containers into despatch or display boxes, cartons or the like, comprising the steps of feeding the containers to a conveying system which has a plurality of compartments for receiving the containers, each compartment extending transversely to the conveying direction, conveying the containers to an ejector station, ejecting a pre-selected number of containers at the ejector station from said compartments to a buffer store where initially the containers are loosely arranged, subsequently pressing the containers in the buffer store closely against each other, moving the tightly packed containers into a position directly in front of the opening of a carton to be filled and loading the tightly packed containers into the opened carton.

Preferably, the containers are filled flat bags, the bags being arranged in the buffer store with their flat sides adjacent to one another, pressure being applied to the bags in the buffer store in a direction normal or substantially normal to their flat sides and the bags being loaded into the carton in a direction parallel or substantially parallel to their flat sides.

In addition to the previously-mentioned advantage of trouble-free insertion of the pre-defined number of containers into a carton the method also provides the advantage of optimum utilization of the space which is to be filled in the individual cartons, since prior to their insertion the bag-like containers are pressed against each other in the direction which is perpendicular to their flat sides so that on the one hand the material within the containers is not crushed but on the other hand no space remains between the containers which are serially arranged with their flat sides and/or the material in the containers approximately uniformly distributed over the entire container space with the consequence that the containers are arranged more closely against each other or are more tightly spaced. Advantageously, an end sensor disposed in the ejector station, for example immediately above the compartments of the conveying device, and/or a counting mechanism disposed in the container feed, indicate that the pre-selected number of containers has reached the ejector station and the ejection operation can commence. While the containers are ejected from the compartments of the conveying device the latter is stationary. The containers can be pushed out of the compartments by means of a comb-like slide the tines of which extend into the compartments. A flat plate which can be reciprocated directly above the individual compartments in the direction thereof can also be used instead of a comb-like slide.

According to a further aspect of the invention there is provided apparatus for performing the above described method, comprising a container feed system, a conveying system which has a plurality of compartments for receiving the containers, each compartment extending transversely to the conveying direction, an ejector station, a buffer store, an ejector system for ejecting a pre-selected number of containers from the conveying system in a direction transversely to the conveying direction to the buffer store, a container thrust system for pressing the containers closely against each other in the buffer store, and a loading system for loading the closely packed containers into a carton.

Advantageously the buffer store is disposed on the side of the conveying system opposite to the ejector system so that the containers can be ejected in a simple manner from the compartments of the conveying system into the buffer store.

A problem solution in which the buffer store has not only a single deck on to which the containers are pushed by the ejector system but is constructed with two or more decks, is particularly advantageous. In this case the ejector system initially ejects a first selected number of containers on to the deck, for example the top deck, of the buffer store. Subsequently, the buffer store is raised so that a second selected number of containers can be pushed on to the next lower deck of the buffer store. This is followed by a movement or further raising of two decks of the buffer store from the direct range of action of the ejector device for opening the carton which will then also be filled in two decks. The containers are advantageously pushed into the carton by two pusher plates, which are situated one above the other but are separated from each other and are associated with the pushing system.

As already mentioned, insertion into the carton takes place only after the containers are previously pressed against each other by means of their flat sides into a tightly packed unit. Advantageously the mutual compression is performed by means of a thrust plate which is moved in a direction perpendicular to the flat sides of the containers by means of a fluid pressure actuated piston-cylinder unit and a wall of the buffer store situated opposite to the thrust plate acts as a abutment. Advantageously the thrust plate has approximately the same surface dimensions as the flat sides of the containers which are to be packaged. However, it can also be larger or slightly smaller. Advantageously the cartons which are to be filled are placed on to a mouthpiece through which the containers are pushed into the carton. Conveniently the said mouthpiece is disposed above the ejector system so that the loading system, which is also disposed above the ejector system and at the same height as the mouthpiece, can push the containers independently into the carton without being obstructed by the ejector system. This achieves the advantage that immediately after ejecting out the containers from the compartments of the conveying system into the buffer store the ejector system can return into its initial position and the conveyor system can convey fresh containers to the ejector station. In the time which elapses before renewed ejecting out of containers from the compartments of the conveying system the containers are pressed against each other and inserted into the carton. This division of work between the ejector system and the loading system therefore gains time so as to obtain a more rapid operating cycle. Advantageously the conveying system extends horizontally. The method according to the invention can also apply to a system in which the conveyor system extends perpendicularly or at an angle.

According to the further aspect of gaining more time so as to obtain a much more rapid operating cycle there is provided a method for inserting filled bag-like containers into despatch or display boxes, cartons or the like, comprising the steps of feeding the containers to a conveying system which has a plurality of compartments for receiving the containers, each compartment extending transversely to the conveying direction, conveying said containers to an ejector station, causing an ejector system to move in synchronism with the conveying device when a pre-selected number of containers has reached the ejector station, and ejecting the pre-selected number of containers from the compartments of the conveying system whilst the ejector system is moving in synchronism with the conveying system.

Preferably, a buffer store is also caused to move in synchronism with the conveying device and the ejector system when the pre-selected number of containers has reached the ejector station, said ejector system ejecting the containers to said buffer store where the containers are initially loosely arranged, and subsequently pressed closely against each other before moving the tightly packed containers into a position directly in front of the opening of a carton to be filled and loading the tightly packed containers into the opened carton.

Alternatively, a device for mounting a carton is also caused to move in synchronism with the conveying device and the ejector system so that containers ejected by said ejector system are loaded directly into a carton.

Preferably, the containers are filled flat bags, the bags being arranged in the buffer store with their flat sides adjacent to one another, pressure being applied to the bags in the buffer store in a direction normal or substantially normal to their flat sides and the bags being loaded into the carton in a direction parallel or substantially parallel to their flat sides.

The advantage of this method is that the operation of filling the compartments of the conveyor system can be continued independently of ejecting a pre-selected number of containers from the compartments and the ejector system will have no idle or waiting times, given optimum matching of the operating steps "ejecting a pre-selected number of containers", "compressing the containers", "inserting the containers into the carton" and "feeding fresh containers." The packing rate in the improved method according to the invention can be substantially increased, which is a specially important feature in view of the present increase in the popularity of bag-like containers, more particularly of flat bags, for packaging foodstuffs. Even a continuous drive of the conveyor system is possible with the present method.

It is however important to ensure that the ejector system as well as the buffer store move in synchronism with the conveyor, system to ensure reliable operation.

Advantageously, the ejector system, conveniently disposed on one side of the conveyor system, and the buffer store situated on the other side of the conveyor system opposite the ejector system, are mounted on a common saddle adapted to reciprocate in a direction parallel to the conveying direction. The said saddle is provided with a coupling device which provides a positive and/or non-positive connection between the saddle and therefore between the ejector system and the buffer store and conveying system as soon as the pre-selected number of containers, reaches the ejector station. This is conveniently indicated by an end sensor disposed in the ejector station or by a counting mechanism disposed in the feed.

It is however also feasible to independently engage and disengage the ejector system and buffer store with and from the conveying system after the containers have been ejected into the buffer store.

It is also feasible for the synchronized motion to be obtained by separate drives for the ejector system and/or buffer.

After the containers are ejected into the buffer the ejector system and buffer are disconnected from the conveying system and return to their starting positions.

An intermittent drive in which the conveying system advances by one compartment at a time after each supply of one or a pre-defined number of containers into a compartment is advantageous in place of a continuous drive for the conveyor system. This kind of drive is trouble-resistant and can be simply controlled by means of a tracer disposed in the container feed system.

According to a further aspect of the invention there is provided an apparatus for performing a method according to the last mentioned method, comprising a container feed system, a conveying system which has a plurality of compartments for receiving the containers, each compartment extending transversely to the conveying direction, an ejector station, an ejector system for ejecting a pre-selected number of containers from the conveying system in a direction transversely to the conveying direction, and means for supporting the ejector system for reciprocating movement in a direction parallel to the direction of movement of the conveying system such that movement of the ejector system in the conveying direction takes place in synchronism with the conveying speed of the conveying system.

Preferably, the apparatus also comprises a buffer store, said means also supporting the buffer store for reciprocating movement in a direction parallel to the direction of movement of the conveying system, a container thrust system for pressing the containers, ejected to the buffer store by the ejector system, closely against each other, and a loading system for loading the closely packed containers into a carton.

BRIEF DESCRIPTION OF THE DRAWINGS

The invention will now be more particularly described with reference to and as shown in the accompanying drawings, wherein:

FIG. 1 shows in diagrammatic form a process routine. First, the bag-shaped containers are supplied by a container feed device 1 to a conveying system 3 and from there to an ejector station 4 having an ejector system 5. As soon as a specific number of containers has reached the ejector station, they are pushed by means of the ejector system 5 into a buffer to store the containers, initially in a loosely adjacent configuration by means of their flat sides, are tightly compressed by a container thrust system 9 in a direction approximately perpendicular to their flat sides. Subsequently the unit of containers, which is thus tightly packed, is moved into a position 11 directly upstream of the opening of a carton that is to be filled and is pushed into the opened carton by means of a push-in system 13 which acts in the direction of the flat sides of the containers.

FIG. 2 shows an exemplified embodiment of an insertion machine 2 for performing the method according to FIG. 1.

First, bag-like containers 17, hereinafter referred to as flat bags, pass from a filling and glueing station, not shown, over the container feed device 1, constructed as a chute, into compartments 15 of the approximately horizontally extending conveying system 3. The sliding surface 63 of the chute is provided with a sensor 67 which indicates that one flat bag or a defined number of flat bags has passed the chute and has been supplied to a compartment 15 of the conveying system 3 which is constructed as a compartment chain. The sensor also serves as a switch for an intermittent drive 69 and after one or a defined number of bags has passed by, the conveying system 3 advances in each case by one compartment. As shown in FIG. 5 the sliding surface 63 is arranged to pivot about an axis 61 which is adjacent to the container feed device 1 and is associated with a chain sprocket wheel 55 that engages the compartment chain so that the pitch can be adjusted in dependence on the weight of the bags that are to be packaged, together with their contents or in dependence on the frictional coefficient of the bag material or in dependence on the height of the ejector opening of a preceding apparatus (see FIG. 5).

As shown in FIG. 5 the support surface 65 of the compartment which is to be filled is situated slightly below the sliding surface 63 so that two or more bags can be supplied to a single compartment without the risk of bunching. If only one bag is provided for each compartment it is sufficient if the support surface 65 of the compartment that is to be filled is situated at the same height as the sliding surface 63.

To facilitate feeding the chute has lateral guides 85, 87 which converge in hopper configuration.

A conveyor belt from whose end the bags drop into the compartments 15 of the conveyor system 3 can be used as feed system in place of the chute.

Figure 1:
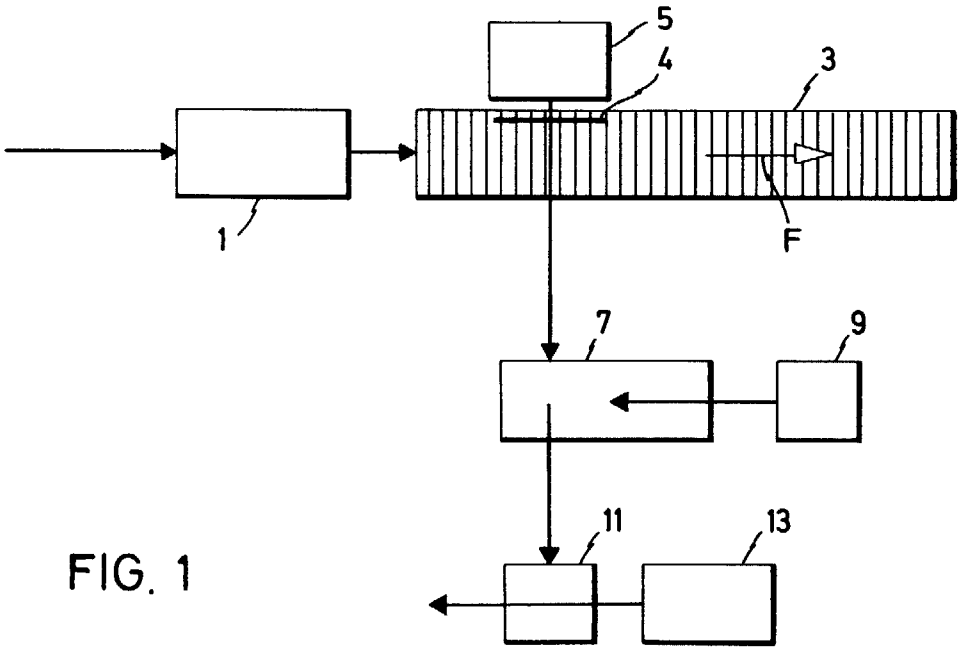
FIG. 1 is a diagrammatic lay-out illustrating one embodiment of the method according to the invention.
Figure 2:
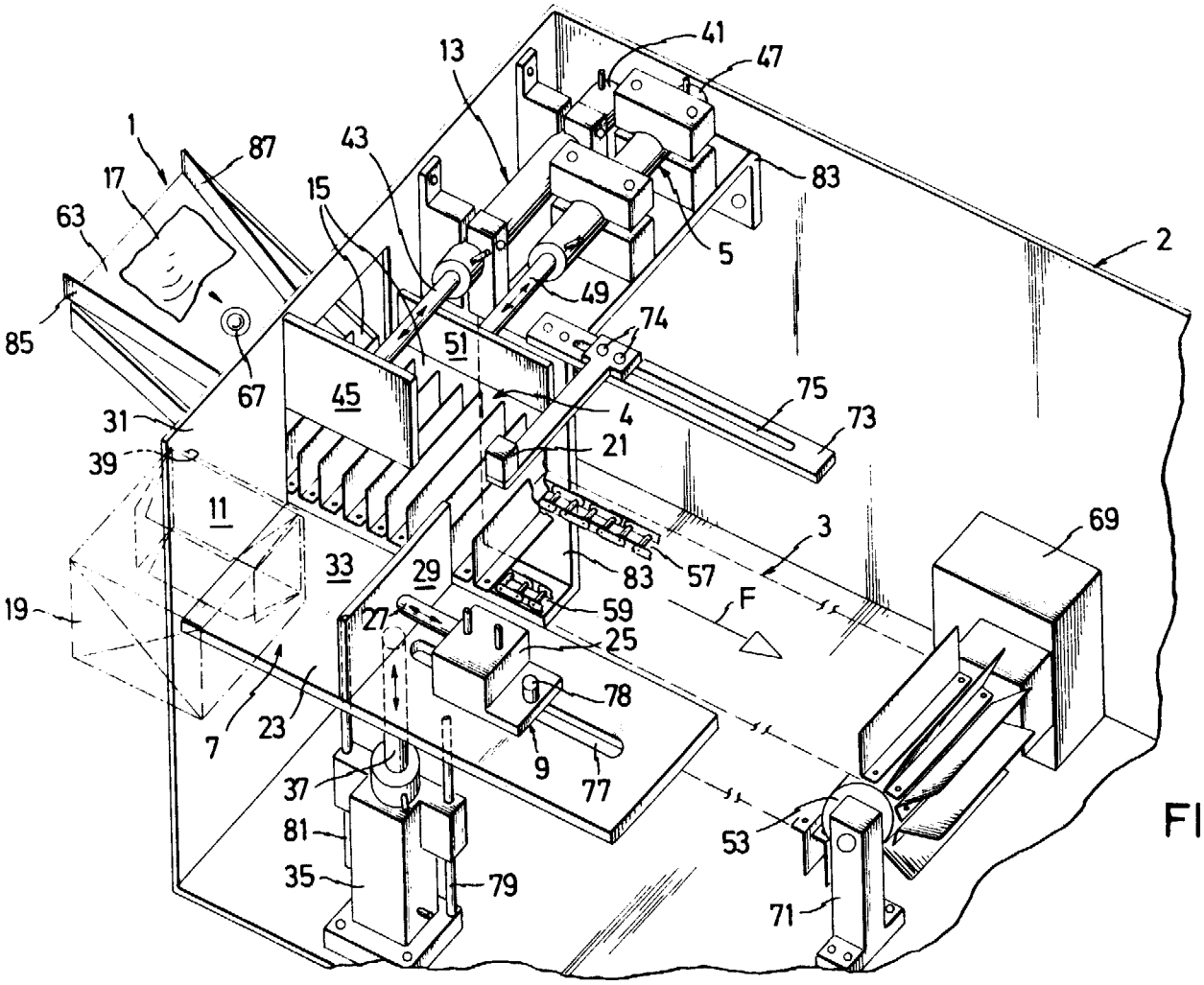
FIG. 2 is a perspective view illustrating the system shown in FIG. 1.

The flat bags 17 in the compartments 15 which are open at the top and on the sides are supplied to an ejector station 4. As soon as an end sensor 21, disposed above the compartments 15 as shown in FIG. 2, indicates that the defined number of flat bags 17 has reached the ejector station 4, the conveying system and bag feed stops and the flat bags are pushed out of the compartments 15 into the buffer store by means of the ejector system 5 in the direction of the compartments 15, i.e. transversely to the conveying direction. Instead of the sensor 21 for the bags slid down the sliding surface of the chute 1 sensor 67 can be used as a counting sensor connected with a counting device, which stops the conveying system after predetermined number of bags slid down the sliding surface of the chute 1. The ejector system 5 comprises a pneumatically operable piston-cylinder unit 47, 49 and a thrust plate 51 which is interchangeably mounted on the free end of the piston rod 49, nearest to the conveying system. The piston-cylinder unit 47, 49 is fixedly coupled to the frame or housing of the machine 2 by means of a bearing plate 83. The pre-define number of containers or flat bags which are to be pushed from the compartments 15 into the buffer store 7 is defined by the length of the thrust plate 51 which corresponds approximately to a multiple of the width of one compartment 15. The end sensor 21 comes into operation at the moment at which it is reached by the flat bag 17 which leads in the conveying direction F. The end sensor 21 is a sensor which operates capacitatively or inductively and therefore without physical contact and by comparison with mechanical or electromechanical switches offers the advantage that it is relatively insensitive to the ingress of dirt. If the thrust plate 51 is to be exchanged for a longer thrust plate with the consequence that the pre-defined number of flat bags to be pushed out of the compartments is increased, the end sensor 21 will have to be displaced in the conveying direction F and vice versa on a retainer 73 which is provided with a slot 75 extending in the conveying direction F. The position of the end sensor is fixed by means of two screws 74.

As shown in FIG. 2 the buffer store 7 has a vertically adjustable deck 23 on to which the flat bags are pushed by means of the ejector system 5. To this end the flat bags are pushed into the space which is defined by a container thrust system 9 and the wall 31 opposite to the compression thrust system and associated with the buffer store 7. This space forms a kind of compression chamber 33 because the flat bags which are initially still loosely arranged with their flat sides in adjacent configuration are pressed against each other by means of the system 9 in a direction perpendicular to their flat sides so that subsequently they bear closely upon each other with their flat sides and form a tightly packed unit. The pressure applied by the system 9 on the flat bag is dimensioned so that the material in the bags is not crushed or otherwise destroyed.

The system 9 comprises a pneumatically or hydraulically operable piston-cylinder unit 25, 27 and a thrust plate 29 which is interchangeable at the free end of the piston rod 27 that acts parallel with the conveying direction. Depending on the pre-defined number of containers or flat bags the system 9 is arranged to slide on deck 23 of the buffer store 27 parallel to the thrust direction. The deck 23 has a slot 77 to permit such sliding motion. The position of the system 9 can be fixed by means of a screw 78.

The thrust plate 29 has approximately the same surface dimensions as the flat sides of the flat bags which are to be pressed against each other. However, it can also be larger or slightly smaller.

The deck 23 of the buffer store 7 can be raised to an opening 11, situated above the ejector system 5 and associated with a carton 19 to be filled, by means of a pneumatically or hydraulically controlled piston-cylinder unit 35, 37 which is mounted on the bottom of the frame or housing of the machine 2. Two guide rods 79, 81 are also provided to ensure reliable guiding of the deck 23.

As shown in broken lines in FIG. 2 the carton is placed on or mounted on a mouthpiece 39 which is disposed above the ejector system 5 at the same height as the oppositely disposed or at the same height as the oppositely disposed loading push-in system 13. The flat bags which have been riased to this height and are pressed against each other by means of the system 9 are pushed by means of the push-in system 13 through the said mouthpiece into the opened carton 19. The push-in system is mounted above the ejector system and opposite the mouthpiece 39 on the frame or housing of the machine 2. Said system comprises a pneumatically or hydraulically controlled piston-cylinder unit 41, 43 and a thrust plate which is interchangeably mounted on the free end of the piston rod 43 nearest to the mouthpiece 39 the length and width of the said thurst plate corresponding approximately to the internal length and width of the mouthpiece 39.

Logically, the thrust plate 45 of the push-in system 13 is slightly shorter than the thrust plate 51 of the ejector system 5 because after being pushed out of the compartments 15 by means of the container thrust system 9, the flat bags will be pressed more closely or more densely against each other, i.e. they will occupy. less space.

FIG. 2 shows all systems in their inoperative or starting position. To prevent flat bags being pushed through the mouthpiece 39 without a carton 19 being mounted thereon a switch, not shown, more particularly an electromechanical switch, is disposed on the mouthpiece and is adapted to release the push-in system only when a carton is mounted on the mouthpiece.

It has been found that it is sufficient if the height of the compartments amounts to approximately half the width of the flat bags which are to be packaged. The bags can then be readily pushed out of the compartments even without a thurst plate 51 constructed in comb configuration.

It is advantageous to provide the top edge of the thrust plate 51 with a bead or to bend it in the thrust direction to prevent the flat bags positioning themselves upright while they are being pushed out of the compartments 15.

As indicated in FIG. 2 the conveyor system 3 is constructed in the form of a compartment chain. The compartments are formed by L-shaped plates which are mounted on two chains 57, 59 which are arranged parallel with each other and circulate over two double-chain sprocket wheels 53, 55. The reference numeral 71 refers to a bearing pedestal which is mounted on the bottom of the machine housing and is provided for the double-chain sprocket wheel 53.

Figure 6:
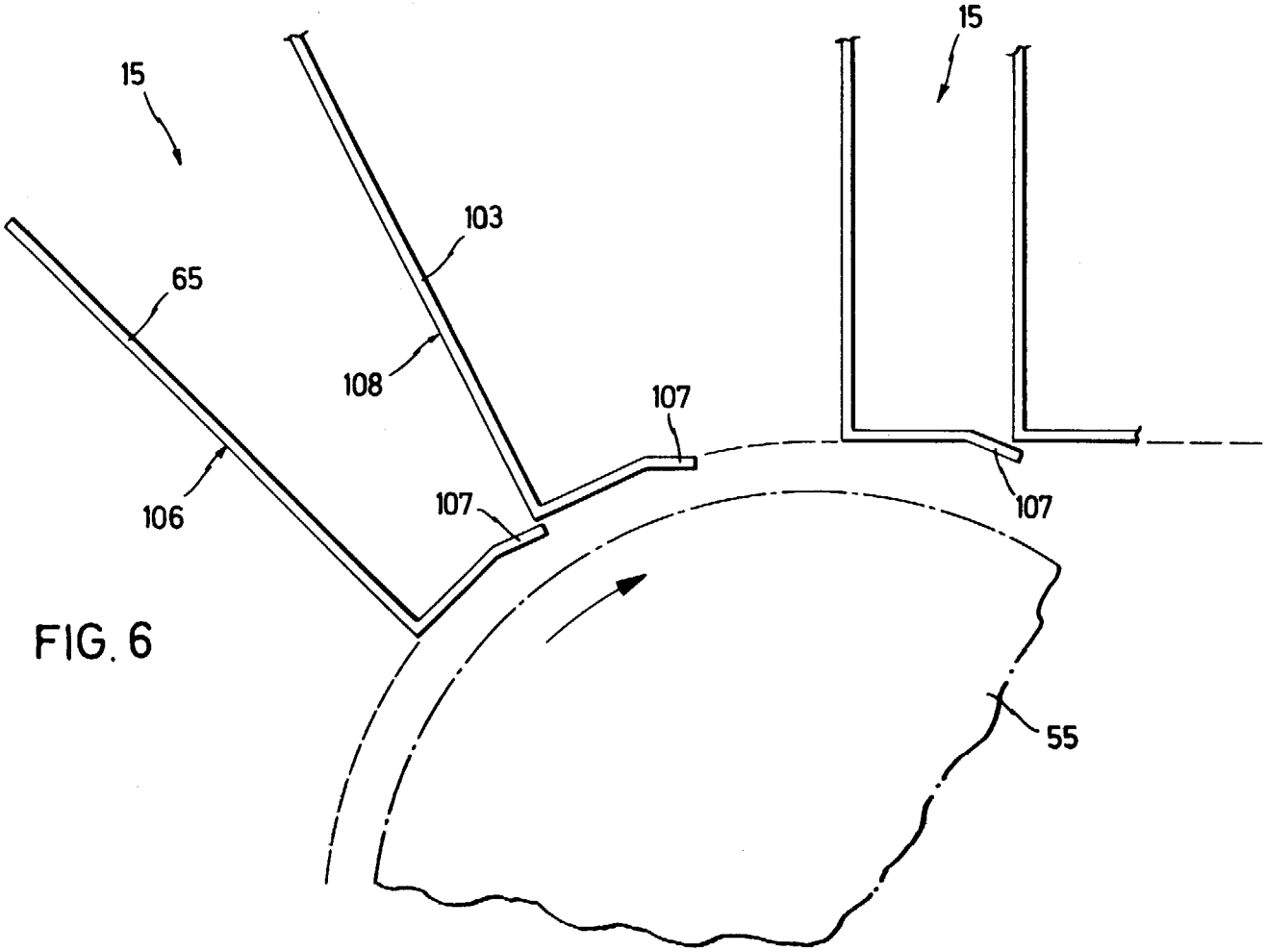
FIG. 6 is a side view on an enlarged scale of part of the conveyor system.
Figure 7:
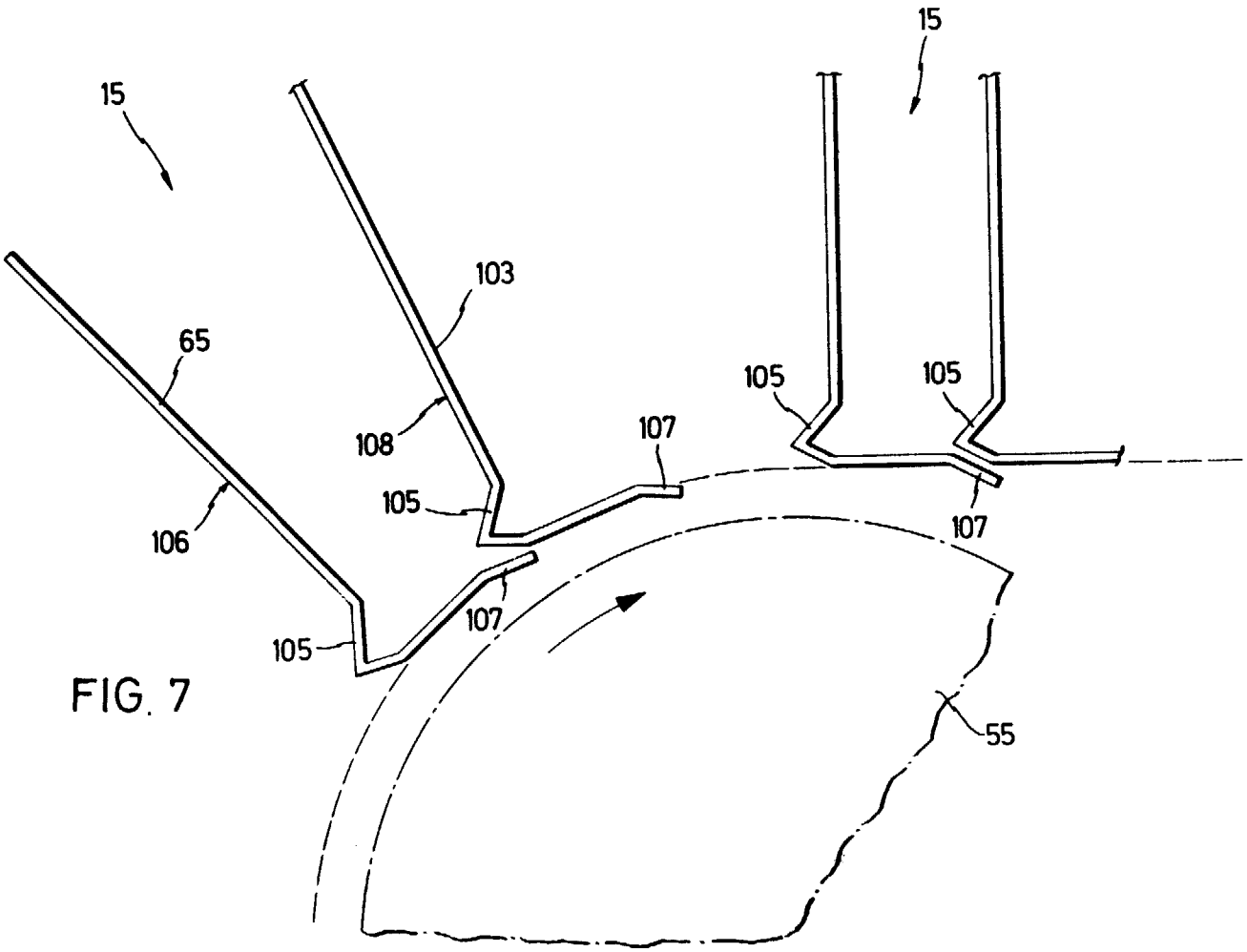
FIG. 7 is a side view of another embodiment of the conveyor system.

It is advantageous to bend the shorter limb of each plate at its free end 107 so that it contantly projects with the least possible distance under the edge of the preceding plate (FIG. 6) to prevent jamming of a bag between the shorter limb of the plate 106, preferably bolted onto the conveyor chains and acting as bag support and secured between the chains 57, 59 on the one hand and the longer limb 103 of a directly previously occupied plate 108 (see FIGS. 6 and 7) even when flat bags 17 drop from the sliding surface 63 into a compartment 15 under the least favourable conditions. FIG. 7 shows a further development of the embodiment according to FIG. 4. In the region of the edges the long limbs of the plates defining the compartments 15 in FIG. 7 each have an indentation 105 oriented against the conveying direction F and shaped in the form of a ridge in FIG. 7. If the narrow side of a flat bag meets the indentation of the previously occupied plate 103 the latter will be deflected on to the support surface 65 of the plate 106 which is to be occupied. There will then be no risk of the narrow side of a bag being jammed between two successive plates 106, 108.

Jamming can also be prevented by mounting the L-shaped plates on a hinged chain. To insert relatively thick or bulgy bags in the cartons the compartment plates 106, 108 illustrated in FIGS. 6 and 7 can be exchanged for other compartment plates whose members, which are mounted on the chains 57, 59 and function as bag support surfaces are longer than the members which define the compartments.

Figure 9:
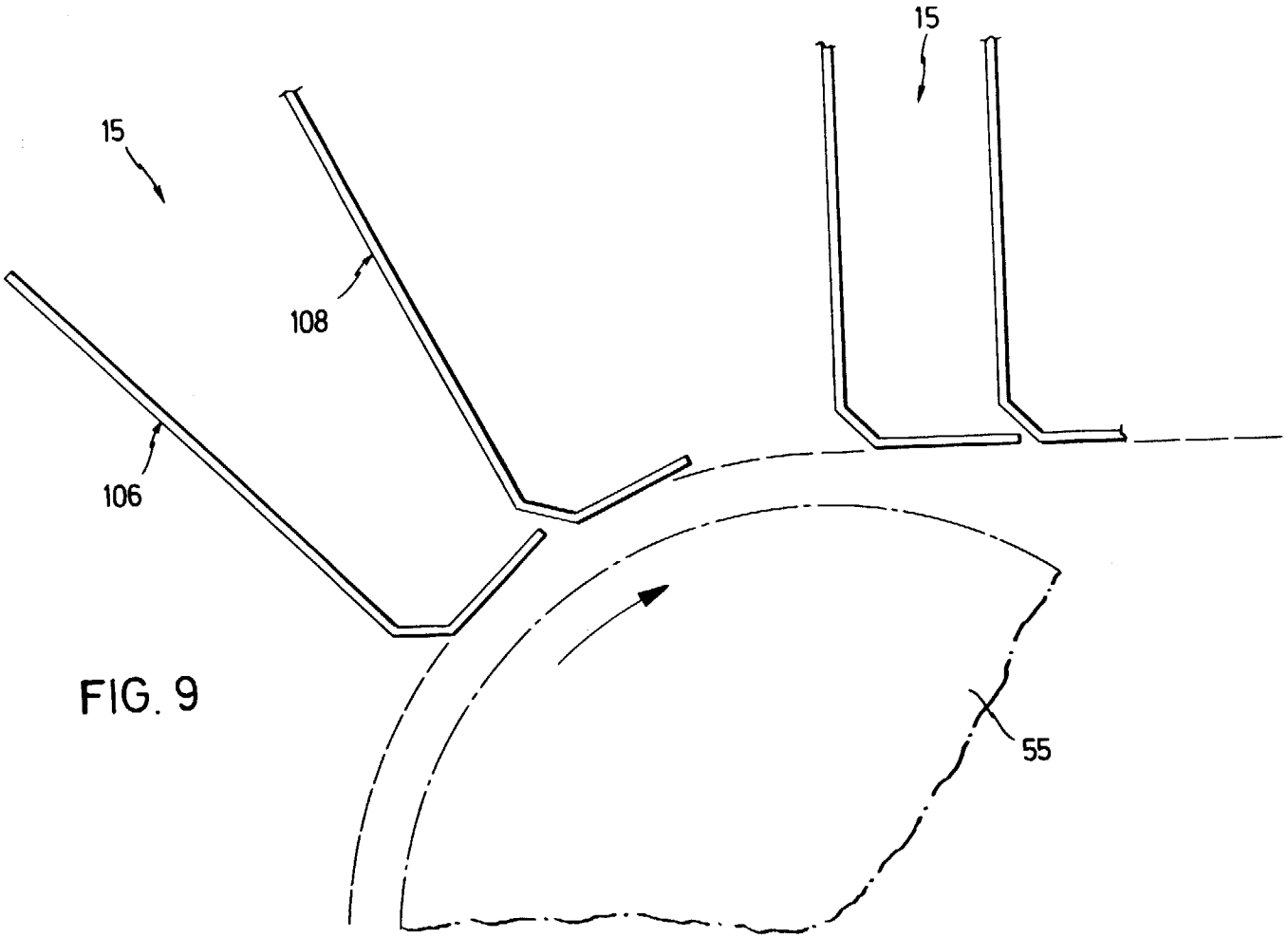
FIG. 9 is a side view on an enlarged scale of part of the conveyor system.

FIG. 9 shows another advantageous embodiment of the L-shaped plates 106, 108. In the region of their edges each of the L-shaped plates 106, 108 is bent twice so that in the edge region the cross-section of the plates is approximately saddle-roof-shaped. The shorter limbs of the plates are mounted on the conveyor chains so that their free ends always project slightly into the space beneath the sloping edges of the preceding plates. This ensures that no bags can be jammed between two successive plates 106, 108.

Figure 8:
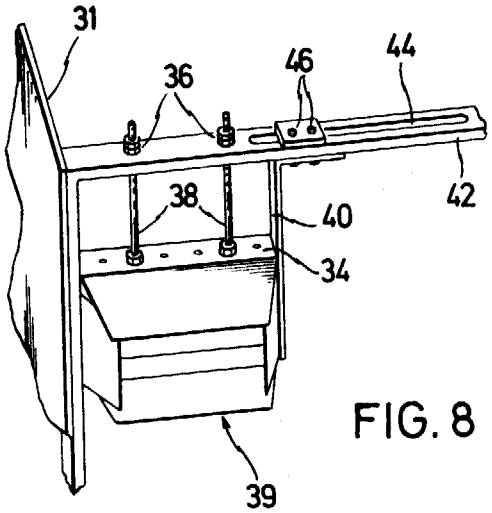
FIG. 8 is a perspective view of a mouthpiece on which cartons to be filled are pushed.
Figure 5:
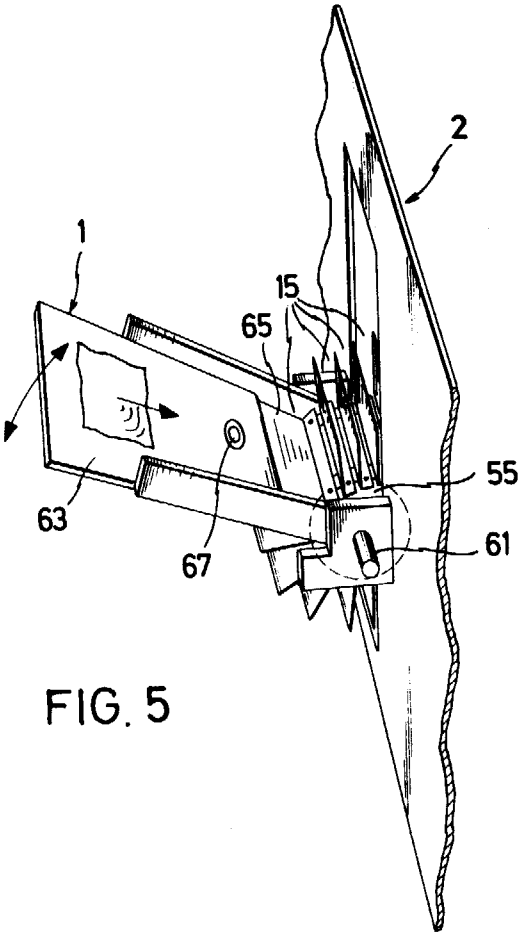
FIG. 5 is a perspective view of a container feed device of the system shown in FIG. 2.

FIG. 8 shows a mouthpiece 39, the upper boundary 34 of which can be vertically adjusted by means of two screws 38 and whose right-hand lateral boundary 40 is laterally slidable in a slot 44 of an upper frame part 42.

The position of the upper boundary 34 is fixed by lock nuts 36 and the position of the lateral boundary 40 is fixed by screws 46 in the slot 44. The mouthpiece illustrated in FIG. 6 can therefore be adjusted in accordance with the length and width of the carton that is to be filled.

Figure 3:
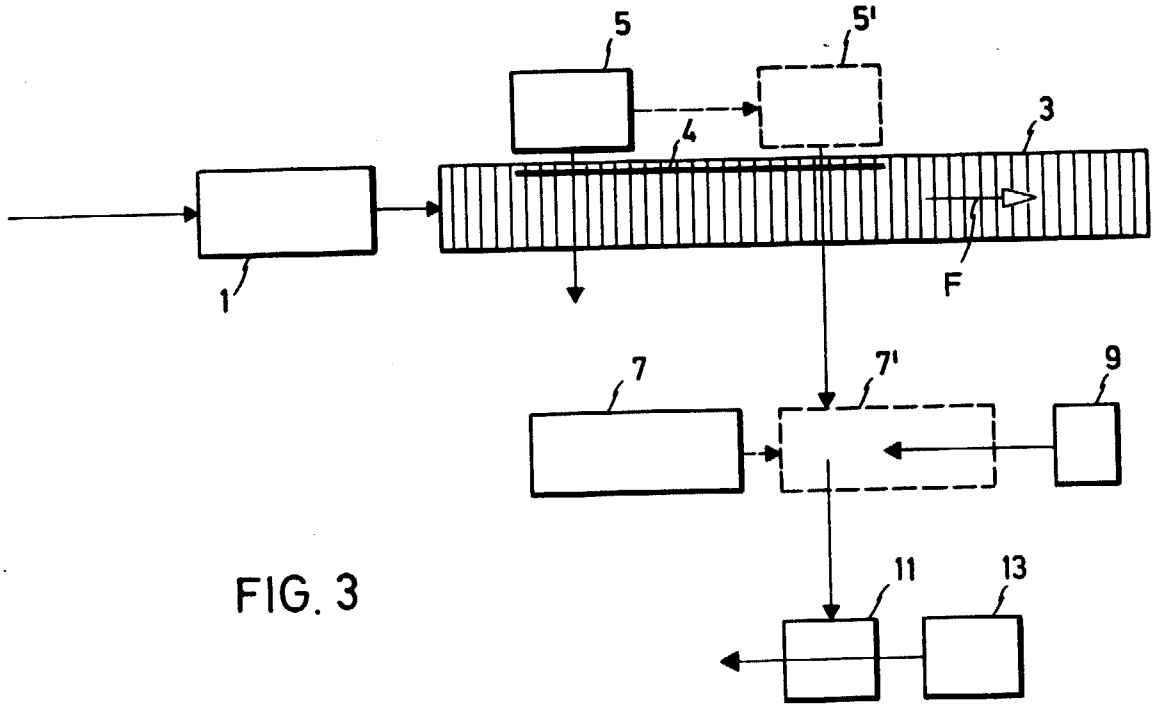
FIG. 3 is a diagrammatic lay-out illustrating another embodiment of the method according to the invention

FIG. 3 shows in diagrammatic form another process routine according to the invention. First, the bag-shaped containers are supplied by a container feed device 1 to a conveying system 3 and from there to an ejector station 4 having an ejector system 5 and, as soon as a specific number of containers has reached the ejector station, they are pushed by means of the ejector system 5 into a buffer store 7. In the said buffer store the containers, initially in loosely adjacent configuration by means of their flat sides, are tightly compressed by a container thrust system in a direction approximately perpendicular to their flat sides. Subsequently the unif of containers, which is thus tightly packed, is moved into a position 11 directly upstream of the opening of a carton that is to be filled and is pushed into the opened carton by means of a push-in system which acts in the direction of the flat sides of the containers.

The ejector system 5, disposed on one side of the conveyor system 3, and the buffer store 7, disposed on the other side of the conveying system and opposite to the ejector system 5, are moved in synchronism with the conveyor system 3 as soon as the pre-selected number of containers reaches the ejector station 4. The containers disposed in compartments of the conveying system pushed therefrom into the buffer store while the ejector system 5 and the buffer store 7 move in synchronism into the positions 5' and 7' respectively. This obviates the need for stopping the conveyor system 3 during the ejection operation.

Figure 4:
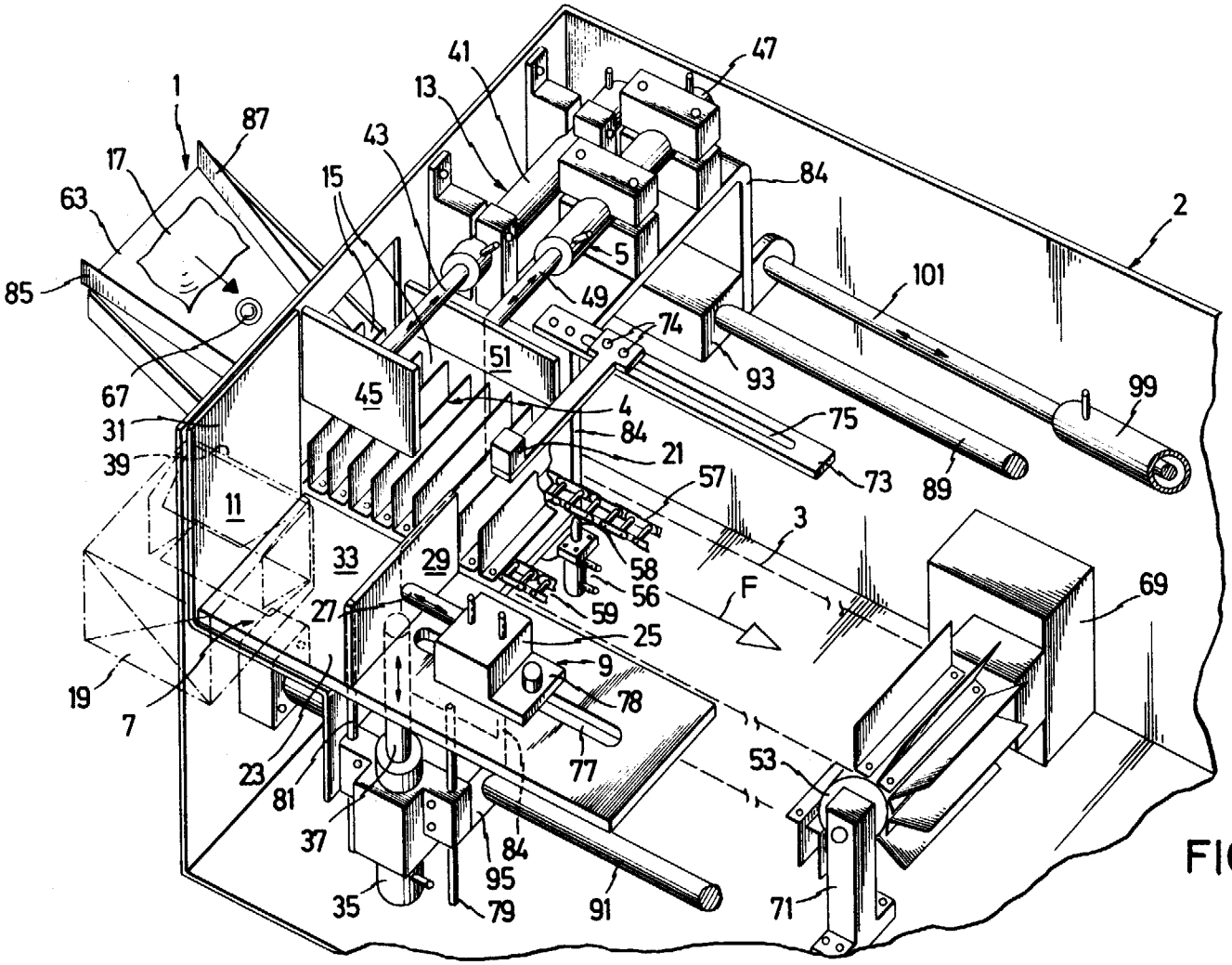
FIG. 4 is a perspective view illustrating the system shown in FIG. 3.

FIG. 4 shows an amplified embodiment of an insertion machine 2 for performing the method according to FIG. 3 It should be pointed out, that for all parts of the embodiment in FIG. 4, which has the embodiment in FIGS. 2, 5 to 9 too, the same reference numbers are used.

First, bag-like containers 17, hereinafter referred to as flat bags, pass from a filling and glueing station, not shown, over the container feed device 1, constructed as a chute, into compartments 15 of the approximately horizontally extending conveying system 3. The sliding surface of the chute 63 is provided with a sensor 67 which indicates that one flat bag or a defined number of flat bags has passed the chute and has been supplied to a compartment 15 of the conveying system 3 which is constructed as a compartment chain. The sensor is also the switch for the intermittent drive 69 and after one or a defined number of bags has passed by, the conveying system 3 advances in each case by one compartment. the top and on the sides are supplied to an ejector station 4. As soon as an end sensor 21, for example arranged in FIG. 3 above the compartment 15, indicates that the pre-defined number of flat bags has reached the ejector station 4 the ejector system 5 and the buffer store 7 will couple with the conveyor system 3 and will be entrained thereby in the conveying direction F. As shown in FIG. 3 the ejector system 5 and the buffer store 7 are mounted on a common saddle 84 which is slidable parallel with the conveying direction F. The saddle has a coupling 56 with a coupling pin 58 can be reciprocated, for example by means of a pneumatically or hydraulically controlled piston-cylinder unit. In the apparatus illustrated in FIG. 2 the conveyor system 3 takes the form of a compartment chain and each compartment 15 is formed by two L-shaped plates which are mounted on two circulating chains 57, 59 arranged parallel with each other and adapted to circulate on two double chain sprocket wheels 53, 55. As soon as the sensor indicates that the pre-selected number of flat bags, which are to be pushed out of the compartments 15, has reached the ejector station 4, the coupling pin 58, situated beneath one chain 57 or 59, moves upwardly and engages with the chain.

The saddle 84 and therefore the ejector system 5 and the buffer store 7 then move together with the conveyor system 3 in the conveying direction F.

The saddle 84 is reciprocatingly supported on two guide rods 89, mounted parallel to the conveying direction in the housing of the apparatus 2 and the guide bearings are designated with the numerals 93, 95. While the saddle 84 is entrained in the conveying direction F the flat bags 17 are pushed out of the compartments 15 into the buffer store 7 by means of the ejector system 5 in the direction of the compartments 15, i.e. transversely to the conveying direction In contrast to the mounting of the push-in or leading system 13 on the form of the apparatus. The loading push-in or loading system 13 can move with the apparatus according to FIG. 3 preferable saddle 84 is disposed above the ejector system 5.

FIG. 3 shows all systems in their inoperative or starting position. The coupling pin 58 again releases the saddle 84 after the flat bags have been pushed into the buffer store 7. The saddle 84 is then pushed back into its starting position by means of a pneumatically or hydraulically controlled piston-cylinder unit 99, 101. The push-out, compression and carton loading operations are repeated when the flat bags 17 are pushed into the carton 19. To prevent flat bags being pushed through the mouthpiece 39 without a carton 19 being mounted thereon a switch, not shown, more particularly an electromechanical switch, is disposed on the mouthpiece and is adapted to release the push-in system only when a carton is mounted on the mouthpiece. Advantageously the drive 69 is provided with a stepping mechanism, not shown, for example a Geneva mechanism or a ratchet lock, if intermittent feed is applied to the compartment chain.

Figure 10:
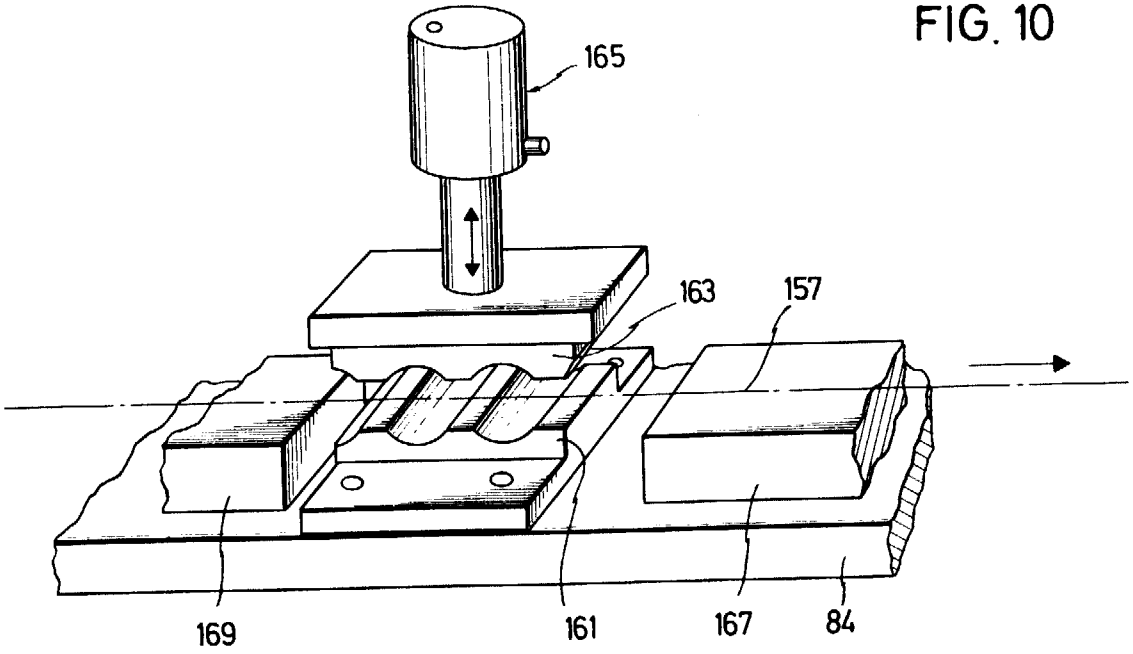
FIG. 10 is a coupling for the saddle.

FIG. 10 shows a preferred coupling for entraining the saddle 84. The coupling shown in FIG. 10 cooperates with a third chain 157 which is arranged parallel to the chains 57, 59 and is driven in synchronism therewith. Advantageously the third 157 circulates over two chain sprocket wheels which are not shown and are mounted on the extended shaft for the double-chain sprocket wheels 53, 55.

The coupling itself comprises a rack segment 161 situated beneath the chain 157 and a complementary rack segment 163 which is arranged to reciprocate above the chain 157. Advantageously the top rack segment 163 is detachably mounted on the free end of the piston rod associated with a pneumatic or hydraulic piston-cylinder unit 165. The piston-cylinder unit 165 as well as the bottom rack segment 161 are mounted on the saddle 84. As soon as the pre-selected number of containers has reached the ejector station the piston-cylinder unit 161 will be actuated and the top rack segment 163 is moved downwardly towards the bottom rack segment 161 and the chain 157, which passes between the rack segments 161, 163, will be clamped.

The rack segments engage positively with the chain links of the chain 157. The saddle 84 will the move in synchronism with the conveyor system. As soon as the ejection operation is completed the top rack segment 163 is again raised and the chain 157 is thus released. The saddle 84 can then be pushed back into its starting position by means of the piston-cylinder unit 99, 101 (FIG. 3).

Chain supports 167, 169 are provided upstream and downstream of the bottom rack segment 161 to ensure that in the unlocked state the chain 157 can pass without obstruction between the rack segments 161, 163. The support surfaces of the chain supports 167, 169 are slightly riased with respect to the teeth of the bottom rack segment 161. In the unlocked state the chain 157 therefore passes over the teeth of the bottom rack segment 161 without touching them.

Advantageously the chain supports 167, 169 are constructed of anti-friction plastics.

The above-described coupling for entraining the saddle 84 can also be arranged so that the coupling elements 161, 163 can be pressed laterally against the chain 157. A non-positive connection can then be obtained between the chain 157 and the clutch elements 161, 163. In this case the clutch elements comprise simple, for example block-shaped compression pads instead of rack segments.

If desired the buffer store 7 and container thrust system may be omitted. In this case a carton is mounted for reciprocating motion in synchronism with the ejector system 5.

What I claim is:

1. A method for inserting filled bag-like containers into despatch or display boxes, cartons or the like, comprising the steps of feeding the containers to a conveying system which has a plurality of compartments for receiving the containers, each compartment extending transversely to the conveying direction, conveying the containers to an ejector station, ejecting a preselected number of containers at the ejector station from said compartments to a buffer store where initially the containers are loosely arranged with their flat sides adjacent to one another, subsequently pressing the containers in the buffer store closely against each other wherein pressure is applied to the bag-like containers by a movably mounted thrust plate in a direction normal to the flat sides of said containers, moving the tightly packed containers into a position out of the direct range of action of an ejector means directly in front of the opening of a carton to be filled and loading the tightly packed containers into the opened carton by a loading plate in a direction parallel to the flat sides of said containers.

2. A method according to claim 1 wherein the conveying system is stationary while the containers are pushed out of the compartments into the buffer store.

3. A method for inserting filled bag-like containers into despatch or display boxes, cartons or the like, comprising the steps of feeding the containers to a conveying system which has a plurality of compartments for receiving the containers, each compartment extending transversely to the conveying direction, conveying said containers to an ejector station, causing an ejector system to move in synchronism with the conveying device when a pre-selected number of containers has reached the ejector station ejecting the pre-selected number of containers from the compartments of the conveying system whilst the ejector system is moving in synchronism with the conveying system, and further including a buffer store, said buffer store is also caused to move in synchronism with the conveying device and the ejector system when the pre-selected number of containers has reached the ejector station, said ejector system ejecting the containers to said buffer store where the containers are initially loosely arranged, and subsequently pressed closely against each other before moving the tightly packed containers into a position directly in front of the opening of a carton to be filled and loading the tightly packed containers into said opened carton.

4. A method as claimed in claim 3, wherein a device for mounting a carton is also caused to move in synchronism with the conveying device and the ejector system so that containers ejected by said ejector system are loaded directly into a carton.

5. A method as claimed in claim 3, wherein the containers are filled flat bags, the bags being arranged in the buffer store with their flat sides adjacent to one another, pressure being applied to the bags in the buffer store in a direction normal or substantially normal to their flat sides and the bags being loaded into the carton in a direction parallel or substantially parallel to their flat sides.

6. A method according to claim 3 wherein the ejector system and buffer store return to their starting position after the pre-selected number of containers is inserted by the loading system into the carton.

7. A method according to claim 3 wherein as soon as the pre-selected number of containers has reached the ejector station the ejector system and the buffer store are coupled to the conveyor system by means of a coupling and are again uncoupled as soon as the pre-selected number of containers have been ejected into the buffer store.

8. A method according to claim 3 wherein an end sensor disposed in the ejector station indicates whether the pre-selected number of containers is disposed in the ejector station.

9. A method according to claim 3 wherein the operating steps of ejecting the containers from the compartments of the conveyor system into the buffer store, pressing together of the containers, inserting the containers into the carton and the return of the ejector system and buffer store into their starting positions occupies only as much time as elapses until a further pre-selected number of containers again reaches the ejector station.

10. A method according to claim 3 wherein the conveyor system is intermittently driven and after a predefined number of containers has been fed into a compartment the conveyor system advances by one compartment.

11. A method according to claim 3 wherein the conveyor system is continuously driven.

12. Apparatus for inserting filled bag-like containers into despatch or display boxes comprising a container feed system, a conveying system which has a plurality of compartments for receiving the containers, each compartment extending transversely to the conveying direction, an ejector station, an ejector system for ejecting a pre-selected number of containers from the conveying system in a direction transversely to the conveying direction, means for supporting the ejector system for reciprocating movement in a direction parallel to the direction of movement of the conveying system such that movement of the ejector system in the conveying direction takes place in synchronism with the conveying speed of the conveying system.

13. Apparatus according to claim 12, wherein the apparatus also comprises a buffer store, said means also supporting the buffer store for reciprocating movement in a direction parallel to the direction of movement of the conveying system, a container thrust system for pressing the containers, ejected to the buffer store by the ejector system, closely against each other, and a loading system for loading the closely packed containers into a carton.

14. Apparatus according to claim 12, wherein the apparatus also comprises a device for mounting a carton, said means also supporting the device for reciprocating movement in a direction parallel to the direction of movement of the conveying system.

15. Apparatus according to claim 13, wherein the ejector system and the buffer store are mounted on a common saddle.

16. Apparatus according to claim 13, wherein the buffer store is disposed on the side of the conveyor system which is opposite to the ejector system.

17. Apparatus according to claim 15, wherein the saddle is provided with a clutch by means of which the saddle and therefore the ejector system and buffer store can be coupled to the conveyor system as soon as the preselected number of containers reaches the ejector station.

18. Apparatus according to claim 12, wherein there is provided a fluid pressure actuated piston-cylinder unit which acts in opposition to the conveying direction and by means of which the ejector system and the buffer store can be pushed back into their starting position as soon as the containers have been ejected into the buffer store.

19. Apparatus according to claim 13, wherein the loading system for inserting the containers into the carton is arranged in stationary form.

20. Apparatus according to claim 13, wherein the loading system together with the ejector system is mounted on the saddle and is therefore arranged for reciprocating movement in a direction parallel to the conveying direction.

21. Apparatus according to claim 12, wherein the ejector station is provided with an end sensor which indicates that the preselected number of containers is situated in the ejector station and which triggers synchronized motion of the ejector system and buffer store with the conveyor system.

22. Apparatus according to claim 21, wherein the end sensor is constructed as an electromechanical switch.

23. Apparatus according to claim 21, wherein the end sensor is arranged to slide in a direction parallel to the conveying direction.

24. Apparatus according to claim 13, wherein the buffer store has at least one deck which can be moved out of the direct range of action of the ejector system and on which said deck the containers are ejected from the compartments associated with the conveying system.

25. Apparatus according to claim 24, wherein the buffer store has two or more decks.

26. Apparatus according to claim 24, wherein the container thrust system comprises a fluid pressure actuated piston-cylinder unit which is disposed on the deck of the buffer store and comprises a thrust plate which is mounted on the free end of the piston rod.

27. Apparatus according to claim 26, wherein the thrust plate together with an oppositely disposed wall of the buffer store forms a pressure chamber into which the containers are ejected and are compressed into a tightly packed unit.

28. Apparatus according to claim 26, wherein the surface dimension of the thrust plate corresponds approximately to that of the flat sides associated with the containers which are to be packaged.

29. Apparatus according to claim 26, wherein the thrust plate is interchangeably mounted on the free end of the piston rod associated with the piston-cylinder unit.

30. Apparatus according to claim 26, wherein the container thrust system is disposed in the buffer store so as to slide therein parallel with the thrust direction in accordance with the preselected number of containers which are to be filled into the carton.

31. Apparatus according to claim 26, wherein the deck of the buffer store can be moved by means of a fluid pressure actuated piston-cylinder unit into a position outside the range of action of the ejector system.

32. Apparatus according to claim 13, wherein outside the range of action of the ejector system, the buffer store is provided with a mouthpiece for receiving a carton which is to be filled, and the loading system for inserting into the carton the tightly pressed containers moved in front of the mouthpiece is situated opposite thereto.

33. Apparatus according to claim 32, wherein the loading system comprises a fluid pressure actuated piston-cylinder unit and a thrust plate, the length and width of which corresponds approximately to the internal length and width of the mouthpiece.

34. Apparatus according to claim 25, wherein the loading system comprises two thrust plates, disposed one above the other but separated from each other by means of which the containers situated in the two-deck buffer store can be inserted in two-deck operation into a carton of corresponding width.

35. Apparatus according to claim 12, wherein the ejector system comprises a fluid pressure actuated piston-cylinder unit and a thrust plate which extends substantially parallel to the conveying direction and is interchangeably mounted on the free end of the piston rod and whose length defines the selected number of containers which are to be ejected from compartments of the conveyor system.

36. Apparatus according to claim 35, wherein the length of the thrust plate corresponds to a multiple of the compartment width.

37. Apparatus according to claim 12, wherein the conveyor system is constructed in the form of a compartment chain and the height of the individual compartments corresponds approximately to half the width of the containers which are to be packaged.

38. Apparatus according to claim 37, wherein the individual compartments are mounted on two chains, arranged parallel to each other and extending over two double-chain sprocket wheels.

39. Apparatus according to claim 37, wherein the individual compartments are mounted on a hinged chain.

40. Apparatus according to claim 12, wherein the container feed device is constructed in the form of a chute which is supported so as to pivot about a horizontal axis normal to the conveying direction.

41. Apparatus according to claim 40, wherein the chute surface is disposed slightly above the container support surface of the compartment which is to be filled at that time so that two or more containers can be supplied to a compartment without risk of bunching.

42. Apparatus according to claim 40, wherein the feeder device is provided with a sensor which switches on the drive of the conveyor system when one or a specified number of containers passes by, so that the conveyor system advances by one compartment at a time.

43. Apparatus according to claim 12, wherein a mouthpiece for supporting cartons is provided, the length and width of the mouthpiece being adjustable in accordance with the length and width of the cartons in use.

44. Apparatus according to claim 17 wherein the coupling for entraining the saddle comprises two coupling elements which cooperate with a third chain which is arranged in parallel to the conveyor system and is drivable in synchronism therewith.

45. Apparatus according to claim 17, wherein the coupling elements are constructed in the form of rack segments engageable with the chain links of the chain.

46. Apparatus according to claim 37, wherein the compartments are formed by L-shaped plates one limb of which is mounted on the circulating chains and the other limb of which defines the internal width of the compartments.

47. Apparatus according to claim 46, wherein the L-shaped plates are bent at least twice in the region of their edges so that in the region of their edges the plates have an approximately saddle-roof-shaped cross-section.

48. Apparatus according to claim 47, wherein the limbs of the L-shaped plates which are mounted on the circulating chains are so mounted thereon that the free ends of the said limbs project for a short distance beneath the edges of the preceding plates.

49. An apparatus for inserting filled baglike containers into despatch or display boxes comprising, a container feed system, a conveying system which has a plurality of compartments for receiving the containers, each compartment extending transversely to the conveying direction, an ejector station, a buffer store, an ejector system for ejecting a preselected number of containers from the conveying system in a direction transversely to the conveying direction to the buffer store, a container thrust system for pressing the containers closely against each other in the buffer store, and a loading system disposed out of the direct range of an ejector means for loading the closely packed containers into a carton.

50. Apparatus according to claim 49, wherein the ejector station is provided with an end sensor which stops the advance motion of the conveying system and triggers the ejector system as soon as a container reaches said end sensor.

51. Apparatus according to claim 49, wherein the buffer store is disposed on the side of the conveying system opposite to the ejector system.

52. Apparatus according to claim 49, wherein the buffer store is constructed in two or more decks.

53. An apparatus for inserting filled bag-like containers into despatch or display boxes comprising, a container feed system, a conveying system which has a plurality of compartments for receiving said containers, each compartment extending transversely to the conveying direction, an ejector station, a buffer store, an ejector system for ejecting a preselected number of containers from said conveying system into the buffer store in a direction transversely to the conveying direction, a container thrust system having a fluid pressure activated piston-cyclinder-unit disposed on the deck of said buffer store and a thrust plate which is mounted on the free end of the piston rod of said piston-cylinder-unit for pressing said containers closely against each other in said buffer store, and a loading system disposed out of direct range of said ejector system for loading said closely packed containers into said carton.

54. Apparatus according to claim 53, wherein the thrust plate in conjunction with an oppositely disposed wall of the buffer store forms a pressure chamber into which the containers are ejected and are pressed against each other to form a tightly packed unit.

55. Apparatus according to claim 53, wherein the surface dimension of the thrust plate is approximately that of the flat sides of the containers which are to be packaged.

56. Apparatus according to claim 53, wherein the thrust plate is interchangeably mounted on the free end of the piston rod associated with the piston-cylinder unit.

57. Apparatus according to claim 53, wherein the container thrust system is disposed in the buffer store so as to slide therein parallel to the thrust direction in accordance with the pre-selected number of containers which are to be filled into the carton.

58. Apparatus according to claim 53, wherein the deck of the buffer store can be moved into a position outside the range of action of the ejector system by means of a fluid pressure activated piston-cylinder unit.

59. Apparatus according to claim 53, wherein the loading system comprises two thrust plates, disposed one above the other but separate from each other by means of which containers, in use, disposed in the two-deck buffer store can be pushed in two-deck configuration into a carton of corresponding width.

60. Apparatus according to claim 53, wherein the length of the thrust plate is equal to a multiple of the compartment width.

61. Apparatus according to claim 53 wherein the conveying system is constructed in the form of a compartment chain and the height of the individual compartments corresponds approximately to half the width of the containers which are to be packaged.

62. Apparatus according to claim 61, wherein the individual compartments are mounted on two parallel chains which extend over two double-chain sprocket wheels.

63. Apparatus according to claim 61, wherein the individual compartments are mounted on a hinged chain.

64. Apparatus according to claim 61, wherein the container feed system is constructed in the form of a chute which is supported so as to pivot about a horizontal axis normal to the conveying direction.

65. Apparatus according to claim 64, wherein the sliding chute is disposed slightly above the container support surface of the compartment which is to be filled so that two or more containers can be supplied to a compartment without risk of bunching.

66. Apparatus according to claim 61, wherein the feed system has a sensor which switches on the drive of the compartment conveyor when a pre-defined number of containers pass by so that the compartment moves forward by one compartment at a time.

67. Apparatus according to claim 53, further including a mouthpiece, said mouthpiece being disposed outside the range of action of the ejector system and on said buffer store having a length and width adjustable in accordance with the length and width of the cartons in use.

68. An apparatus for inserting filled bag-like containers into despatch or display boxes comprising, a container feed system, a conveying system which has a plurality of compartments for receiving the containers, each compartment extending transversely to the conveying direction, and ejector station, a buffer store, and ejector system for ejecting preselected number of containers from the conveying system in a direction transversely to the conveying direction to the buffer store, a container thrust system for pressing the containers closely against each other in the buffer store, and a loading system disposed out of the direct range of the ejector system for loading the closely packed containers into a carton, said ejector station being provided with an end sensor which stops the advance motion of the conveying system and triggers the injector system as soon as a container reaches said end sensor, said end sensor being arranged to slide in a direction parallel to the conveying direction.

* * * * *